United States Patent [19]

Hönig

[11] 4,082,642

[45] Apr. 4, 1978

[54] MEASURING ARRANGEMENT

[76] Inventor: Helmut Hönig, Seebachergasse 10, 8010 Graz, Austria

[21] Appl. No.: 628,121

[22] Filed: Nov. 3, 1975

Related U.S. Application Data

[63] Continuation of Ser. No. 340,318, Mar. 12, 1973, abandoned.

[30] Foreign Application Priority Data

Mar. 13, 1972 Austria ..... 2074/72

[51] Int. Cl.[2] ..... C25D 13/00; C25D 13/06

[52] U.S. Cl. ..... 204/299 EC; 204/1 T; 204/181 R; 204/195 R; 204/300 EC; 324/30 R; 324/189; 324/71 R

[58] Field of Search ..... 204/180 R, 181, 299 EC, 204/300, 195 R, 1 T; 324/30 R, 189, 71 R, 72

[56] References Cited

U.S. PATENT DOCUMENTS

| | | | |
|---|---|---|---|
| 3,627,661 | 12/1971 | Gordon et al. | 204/181 |
| 3,658,676 | 4/1972 | DeVittorio et al. | 204/181 |
| 3,676,316 | 7/1972 | Domokos et al. | 204/181 |

*Primary Examiner*—Arthur C. Prescott
*Attorney, Agent, or Firm*—A. W. Breiner

[57] ABSTRACT

A measuring method or arrangement for the quick, accurate, and safe measurement of electrical parameters of binders for the electrocoating process is described. According to the arrangement, digital measuring results are obtained by inserting into a deposition circuit a precision resistor $R_J$(1), a voltage-frequency-converter (2), pertinent counter unit (3), intermediate storage unit (4), and recording unit (5) for recording of the Coulomb yield; a time element (6) for interruption of the impulse sequence coming from said voltage-frequency-converter (2) after from about 50–100 msec., an assigned counter unit (7), an intermediate storage unit (8), recording system (9), a multiplier step (11), which carries out an analogous multiplication of the voltages with one another occurring at said precision resistor $R_J$(1) and on the voltage divider $R_{US}$(10), a voltage-frequency-converter (12) for the conversion of the analogous product from (11) into impulses, a counter unit (13), an intermediate storage unit (14), and a recording system (15).

7 Claims, 1 Drawing Figure

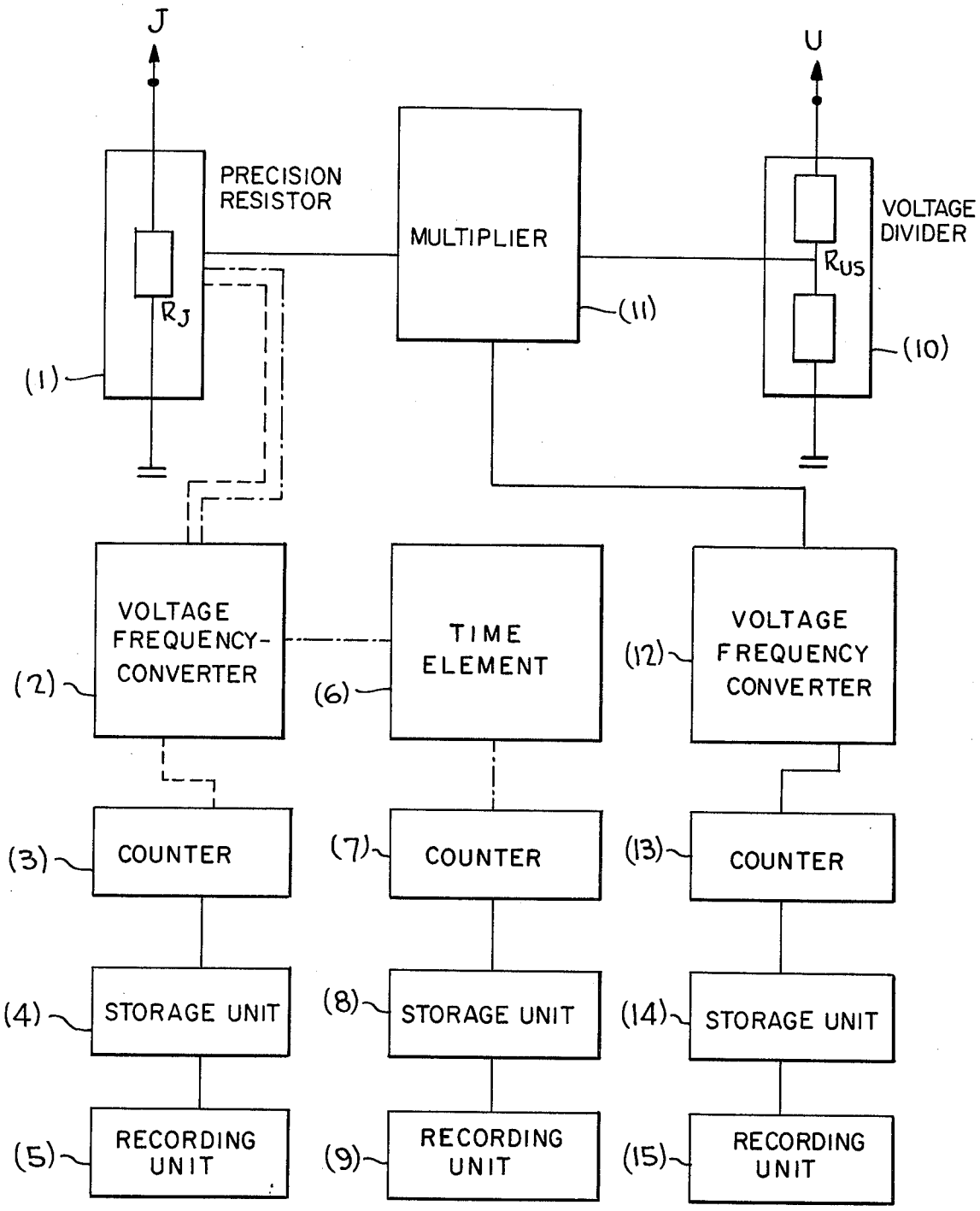
J
U
PRECISION RESISTOR
MULTIPLIER
VOLTAGE DIVIDER
$R_J$
$R_{US}$
(1)
(11)
(10)
VOLTAGE FREQUENCY-CONVERTER
TIME ELEMENT
VOLTAGE FREQUENCY CONVERTER
(2)
(6)
(12)
COUNTER
COUNTER
COUNTER
(3)
(7)
(13)
STORAGE UNIT
STORAGE UNIT
STORAGE UNIT
(4)
(8)
(14)
RECORDING UNIT
RECORDING UNIT
RECORDING UNIT
(5)
(9)
(15)

MEASURING ARRANGEMENT

This is a continuation of application Ser. No. 340,318 filed Mar. 12, 1973 now abandoned.

FIELD OF INVENTION AND BACKGROUND

This application relates to a measuring method or arrangement which permits the quick, accurate, and safe determination of the most important electric parameters of binders which are used for the electrocoating process. These parameters include the electrochemical deposition equivalent (or Coulombic yield); the measurement of the peak current occurring at the beginning of the deposition, and the measurement of the electric energy used for coating.

As used herein, the electrochemical deposition equivalent is the charge volume which must be used in order to deposit one milligram of a binder (Cb/mg). The reciprocal value is designated as the Coulombic yield. From this value, the efficiency of the binder deposition can be determined, as well as the degree of neutralization of the resin. Moreover, the measurement can be used for production control, i.e., to determine deviating coating characteristics, for example, a higher or lower acid number in the composition or the presence of foreign electrolytes. The knowledge of the peak current which occurs at the beginning of coating operation, is of decisive importance for the comparison of ELECTROCOATING (EC) resins under variable conditions, or it can serve for the determination of the critical current density at which a rupture of the film occurs during coating. The peak current is also important in determining the requirements of the electrical installations, including the size of rectifier elements, thyristors, and the surge current stress of electric installations such as laboratory rectifiers, etc. The knowledge of the electric energy needed for the coating of an article permits the calculation of the current costs, as well as the costs for the installations of an electrodeposition bath (ETL), such as transformers and cooling installations.

The Coulomb measurement, i.e., the determination by measurement techniques of the flowed charge volume, hitherto had been determined with difficulties. In the case of coatings under a constant voltage, a peak current occurs at the beginning of the deposition, and afterwards a quick reduction of current occurs as a result of the build-up of the insulating paint film; whereby one can almost speak of an exponential drop of the current flow. The classical method of Coulomb measurement with the aid of a coulometer cannot be employed since the deposition of silver in the case of the high currents which occur (up to 20 A in the case of surfaces of 200 $cm^2$ that are to be coated) cannot be accurately determined with known measuring techniques, and the utilization of the measuring results is cumbersome and time consuming.

As a further measuring method the X—Y-recorder which records the change of the current on a continuous paper tape was suggested. With this recorder, however, it turned out that the mechanical recording of the current/time curve is too slow, so that the first deposition phase is determined only imprecisely. Moreover, it was necessary to cut out the curve and weigh the weight of the paper in comparison with the weight of the paper of known Coulomb quantities to determine the number of the Coulombs which had flowed. This resulted in an error in measurement up to about 10%.

In the case of integrating recorders, the cumbersome cutting and weighing of tape was eliminated. However, the mechanical inertia of the writing system still had to be taken into consideration, and was still a source for error inasmuch as such recorders require at least one second in order to achieve their maximum deflection.

Another frequently used method for determining the number of the Coulomb is by deposition under a constant current intensity. This method has the disadvantage in that the build up of the film is accomplished under basically different prerequisites. Moreover, the duration of measurement is limited in time, since with the development of the insulating paint film the deposition voltage increases until, upon exceeding a certain voltage, the rupture of the film occurs and after the no defined deposition takes place.

The measurement of the peak current occurring at the beginning of the coating provides particular difficulties, since after only a short time the flow of current is reduced very considerably due to the resistance of the film which builds up. Values obtained by experience show that in the case of the usual voltages, the deposition current after 2–3 sec. of coating will reach only half of its starting value. A precise measurement of this peak current could only be done before this with the help of a storage oscillograph which alone is in a position to reproduce one-time processes such as depositions of electrocoating (ETL) binders ("Elektrotauchlackierung") on the picture screen. The recording of the change of the current with the electron ray of an oscillograph tube is accomplished almost without inertia. However, working with such an oscillograph is very expensive and time consuming and requires experienced personnel. Apart from this, measurements of oscillographic peak current can be carried out only with a stabilized DC voltage, since the half waves of the rectified AC voltage of a rectifier used customarily for the electrodeposition (ETL coating) are almost of the same order of magnitude as the duration of the peak voltage itself (width of the half WAVE 10 msec. duration of peak current 50–100 msec.). Energy that is to be used for coating can be calculated from the deposition voltage and from the Coulomb quantity that has flowed during this time. For the case of a coating under a constant DC voltage there are no problems. However, such voltage is almost never available, since for the high voltages and currents which occur during the electro-(ETL) coating, the apparatuses necessary for this purpose are far too costly. In addition, under such conditions is too far removed from practice to be of value. The rectifier installations which are in use, in part have inner resistances which cannot be neglected, and in addition voltage and current distortions occur which cannot be measured with volt and ammeter, whenever the electric control is accomplished via a thyristor control. In practice, therefore, the elastic energy which is used up in the case of coating can be determined only approximately.

OBJECTS AND GENERAL DESCRIPTION

Accordingly, it is a primary object of the present invention to develop a method of measurement which does not have the disadvantages of the above mentioned arrangements and which permits a quick and precise determination of the above mentioned values.

The invention pertains to a measuring arrangement for the determination of electric parameters of binders used for the electrodeposition of coatings, and especially of the deposition equivalent, the peak current which occur during coating and of the energy needed for coating. The measuring arrangement, referring to the drawing, is characterized in that for achieving digital measuring results, a measuring system will be inserted into a deposition circuit which system consists of a precision resistor $R_J$ 1, a voltage-frequency-converter 2, pertinent counter unit 3, intermediate storage unit 4, and recording unit 5 for recording the Coulombian yield, a time element 6 for interruption of the pulse sequence coming from the voltage-frequency-converter 2 at from about 50–100 msec., a pertinent counter unit 7, intermediate storage unit 8, recording system 9, of a multiplier step 11 which carries out an analogous multiplication of the voltages with one another occurring on the precision resistor $R_J$ 1 and on the voltage divider $R_{US}$ 10, a voltage-frequency-converter 12 for the conversion of the analogous product from 11 into impulses, a counter unit 13, an intermediate storage unit 14 and a recording system 15.

For the measurement of the various values, in all cases the signals analogous to the temporal change of the current or of the voltage are converted into impulses which are then counted and stored. A voltage changing with the temporal change of the current on a precision resistor is selected as the analogous signal. This voltage is then used for the purpose of controlling the feed back of a square wave generator in such a way that the frequency of its impulses is proportional to the voltage and thus to the current. The impulses are counted, stored and made visible on digital display tubes. Therefore, one can read immediately upon conclusion of the measurement the current quantity in Coulomb, i.e., the peak current which occurred in amperes or the energy used in Watt·sec. These values can also be processed directly and can be used for the purpose of controlling the process by triggering of control circuits or by feeding into a computer.

The individual measuring functions of the device will now be explained on the basis of a block diagram (FIG. 1).

(A.) Coulomb measurement

The voltage drop on the precision resistor $R_J$ 1 produces in the DC-AC-converter 2 a frequency proportional sequence of impulses. The negative impulses appearing at the exit of the converter are converted into positive impulses in a gate circuit, then they are counted in decimal counter units consisting of decimal counters 3, stored in intermediate storage 4, then displayed in decoder/driver and recording tubes 5 and the sum is retained after the completion of the measurement. Advantageously the counter frequency is selected in such a way that a frequency of 100 Hz will equal a charge quantity of 1 Coulomb, corresponding to a preselected voltage drop on the precision resistor $R_J$1. The smallest recorded charge quantity therefore amounts to 0.01 Coulomb.

(B.) Measurement of the peak current

The measurement of the peak current rests in principle on the same method as the Coulomb measurement. The voltage drop on the precision resistor $R_J$1 produces impulses in the converter 2 and these impulses are counted. Differing from the Coulomb measurement, however, the counting process is stopped at after about 50–100 msec. The number appearing on the recording system now designates the charge quantity that has flowed in the first 50–100 msec. This charge quantity (Coulomb) which has flowed in the first 50–100 msec. is the peak current which is to be multiplied by the factor 10. In the case of a chosen frequency of 100 Hz per 1 Asec a recorded 10 on the recording system corresponds to a peak current of 1 A. The smallest peak current which can be determined is 100 mA. The time constant of 50–100 msec. was selected because peak current measurements with the help of a storage oscillograph have shown that the duration of the peak current lies in the order of magnitude of 50–200 msec.

The time element 6 functions in the following manner: Prior to starting of the measurment a bistable multivibrator must be put into the state that the potential 1 ( + 5 V) appears at its outlet. Through this potential the inlet of a gate is opened. Whenever the current starts to flow on the precision resistor $R_J$ 1, and whenever the first impulse appears at the exit of said gate, then said impulse by way of an additional gate can switch through and turn on a monostable sweep stage. The latter jumps at its outlet from the potential 0 ( 0 V) to 1 and thus opens a third gate. The stretch between the first gate and the third gate is thus open to the impulses coming from the converter 2 for the time for which the monostable sweep stage was adjusted (50 –100 msec.) and said impulses are counted with decimal counters 7, intermediate storages 8, decoder/driver and recording tubes 9.

In order to avoid, however, after the turning off of the monostable sweep stage, that the latter will again be switched on by a new impulse coming from the inlet, the first impulse, which was used for switching on, is used for the purpose of changing over the bistable sweep stage in such a way that as a result of it the second gate is locked for further impulses. The time element 6 can be put in operation again only externally by operating a key.

(C.) Measurement of energy

The energy measurement takes place in such a way that the voltages proportional to the deposition current and voltage and dropping at the precision resistor $R_J$ 1, and the voltage divider $R_{US}$ 10 are multiplied with one another with the help of a multiplier step 11. The product which appears again in the form of a voltage at the exit of the multiplier step 11 is converted into impulses in a converter 12, which impulses are counted in decimal counter units consisting of decimal counters 13, intermediate storages 14, decoder/driver and recording tubes 15, and the sum is retained after completion of the measurement.

The energy measuring step can be constructed for example in such a way that the energy of a maximum 6000 W.s per second corresponding to a voltage of 300 V and a current of 20 A can be measured. The smallest measurable energy amounts to 10 W.s per second. In order to achieve these measuring values an inlet of the multiplier step 11 is connected with precision resistor $R_J$ 1 and the other is connected to the voltage divider $R_{US}$ 10. Thus the measurement of the current is at the precision resistor $R_J$ 1, the voltage measurement is by way of the voltage divider $R_{US}$ 10.

The measurement of energy according to the method of the invention is accomplished with the exclusion of voltage fluctuations and disturbances by the inner resistance of rectifier installations and saw tooth impulses which occur in the case of thyristor controls.

It is claimed:

1. An arrangement for measuring electrical parameters of binders subjected to an electrodeposition current, said arrangement comprising, in combination resistor means for providing a voltage proportional to said electrodeposition current;

converter means connected to said resistor means for producing a sequence of impulses having a frequency proportional to said voltage;

counter means connected to said converter means for counting said impulses, and having an output for providing a cumulative count of said impulses; and recording means connected to said output for recording at a predetermined rate said cumulative count, whereby the charge yield of said binder is recorded.

2. An arrangement as defined in claim 1 wherein said recording means includes a storage means connected to said counter means for storing, at selected time intervals, said cumulative count provided by said output, whereby successive values of the charge yield of said binder are retained.

3. An arrangement as defined in claim 1 including timing means connected to said converter means for receiving said impulses, said timing means acting to pass said impulses only during a predetermined initial time period;

additional counter means connected to said timing means for counting said impulses, and having an output for providing a cumulative count of said impulses passed by said timing means; and additional recording means connected to said output of said additional counter means for recording at said predetermined rate said cumulative count of said impulses passed by said timing means, whereby said peak current during said predetermined initial time period is recorded.

4. An arrangement as defined in claim 3 wherein said additional recording means includes an additional storage means connected to said additional counter means for storing, at said selected time intervals, said cumulative count provided by said output of said additional counter means, whereby successive values of the peak current are retained.

5. An arrangement for measuring electrical parameters of binders subjected to an electrodeposition energy, said arrangement comprising, in combination resistor means for providing a voltage proportional to said electrodeposition energy;

converter means connected to said resistor means for producing a sequence of impulses having a frequency proportional to said voltage;

counter means connected to said converter means for counting said impulses, and having an output for providing a cumulative count of said impulses; and recording means connected to said output for recording at a predetermined rate said cumulative count, whereby said electrodeposition energy is recorded.

6. An arrangement as defined in claim 5 wherein said binder is subjected to an electrodeposition current and an electrodeposition voltage, said resistor means including precision resistor means for providing a voltage proportional to said electrodeposition current, voltage divider means for providing said electrodeposition voltage, and multiplier means connected to said resistor means and said voltage divider means for providing said voltage proportional to said electrodeposition energy.

7. An arrangement as defined in claim 5 wherein said recording means includes a storage means connected to said counter means for storing, at selected time intervals, said cumulative count provided by said output of said counter means, whereby successive values of said electrodeposition energy are recorded.

* * * * *